US007873311B2

(12) United States Patent
Hara

(10) Patent No.: US 7,873,311 B2
(45) Date of Patent: Jan. 18, 2011

(54) BELT TRANSFER DEVICE FOR IMAGE FORMING APPARATUS

(75) Inventor: Kazuhiro Hara, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 100 days.

(21) Appl. No.: 12/326,524

(22) Filed: Dec. 2, 2008

(65) Prior Publication Data

US 2009/0148200 A1 Jun. 11, 2009

Related U.S. Application Data

(60) Provisional application No. 60/992,694, filed on Dec. 5, 2007.

(51) Int. Cl.
*G03G 15/00* (2006.01)
*G03G 15/16* (2006.01)

(52) U.S. Cl. ..... 399/302; 399/165; 399/303

(58) Field of Classification Search ..... 399/302, 399/303, 308, 313, 162, 165; 198/804, 510.01, 198/810.03

See application file for complete search history.

(56) References Cited

U.S. PATENT DOCUMENTS

| | | | | |
|---|---|---|---|---|
| 5,784,676 | A * | 7/1998 | Iseki et al. | 399/165 X |
| 6,181,900 | B1 * | 1/2001 | Lee et al. | 399/165 |
| 6,871,038 | B2 * | 3/2005 | Fujiwara | 399/303 |
| 7,389,068 | B2 * | 6/2008 | Ito | 399/165 |
| 2002/0085864 | A1 * | 7/2002 | Abe | 399/302 X |
| 2007/0059059 | A1 * | 3/2007 | Fujino | 399/329 |
| 2007/0147894 | A1 * | 6/2007 | Yokota | 399/165 |

FOREIGN PATENT DOCUMENTS

| | | |
|---|---|---|
| JP | PH04-133931 | 5/1992 |
| JP | P2003-201038 | 7/2003 |
| JP | P2007-041530 | 2/2007 |
| JP | P2007-139997 | 6/2007 |
| JP | 2008-268954 A * | 11/2008 |

* cited by examiner

*Primary Examiner*—Sophia S Chen
(74) *Attorney, Agent, or Firm*—Patterson & Sheridan, LLP

(57) ABSTRACT

In a belt transfer device according to an embodiment, rotation of a rear side detection roller or a front side detection roller, which contacts with a rib of a transfer belt and is rotated, is converted into linear driving by using a worm gear. The movement of a linear movement shaft is transmitted to a steering roller through a slider. The steering roller is tilted and meandering of the transfer belt is regulated.

25 Claims, 12 Drawing Sheets

BELT TRANSFER DEVICE FOR IMAGE FORMING APPARATUS

CROSS REFERENCE TO RELATED APPLICATION

This invention is based upon and claims the benefit of priority from Provisional U.S. Patent Application 60/992,694 filed on Dec. 5, 2007, the entire contents of which are incorporated herein by reference.

TECHNICAL FIELD

The present invention relates to an endless belt installed in an image forming apparatus, and particularly to a belt transfer device for an image forming apparatus, which regulates meandering of an endless belt at the time of traveling.

BACKGROUND

In an image forming apparatus such as a tandem type multi function peripheral (MFP) or a printer, toner images of plural colors are sequentially superimposed and transferred on a transfer belt or on a sheet transferred by a transfer belt, and a color toner image is formed. And an image forming apparatus a tandem type MFP or a printer, toner images of plural colors are sequentially superimposed and transferred on a transfer belt, and a color toner image is formed. In this tandem type, when the transfer belt meanders, the image quality of the color toner image is remarkably deteriorated by color shift. Thus, hitherto, there are units for correcting the meandering of the transfer belt. As one of such units, for example, Japanese Patent No. 2868879 discloses a belt drive unit in which a steering roller to change the traveling direction of a transfer belt is tilted by using a balance between the elastic force of a spring and the rotation forces of guide rollers at both sides of the steering roller.

However, in the unit of the related art, since the elastic force of the spring is used for the movement of the steering roller, the high-speed property and reliability are insufficient. Thus, it is not appropriate to install the unit in a high-performance and high-speed MFP or the like in which high image quality is required.

Then, the development of a belt transfer device for an image forming apparatus is desired in which when the transfer belt meanders, the transfer belt is returned to a normal direction at high speed, and by this, a high quality color image without color shift can be obtained.

SUMMARY

According to an aspect of the invention, the traveling direction of the transfer belt is corrected to a normal direction to the distortion and color shift of a toner image on the transfer belt are prevented and a high quality toner image is obtained without fail, by transmit meandering of a transfer belt to a steering roller at high speed and accurately.

According to an embodiment of the invention, a belt transfer device includes a belt member that supports an image and is rotated and traveled, a first detection roller that contacts with a first end of the belt member in a width direction and is rotated, a second detection roller that contacts with a second end of the belt member opposite to the first end and is rotated, a conversion member that converts rotation of the first detection roller or the second detection roller into linear driving, a transmission member driven by the linear driving of the conversion member and a steering member that changes a direction of a rotation traveling of the belt member by an operation of the transmission member.

DETAILED DESCRIPTION

Figure 1:
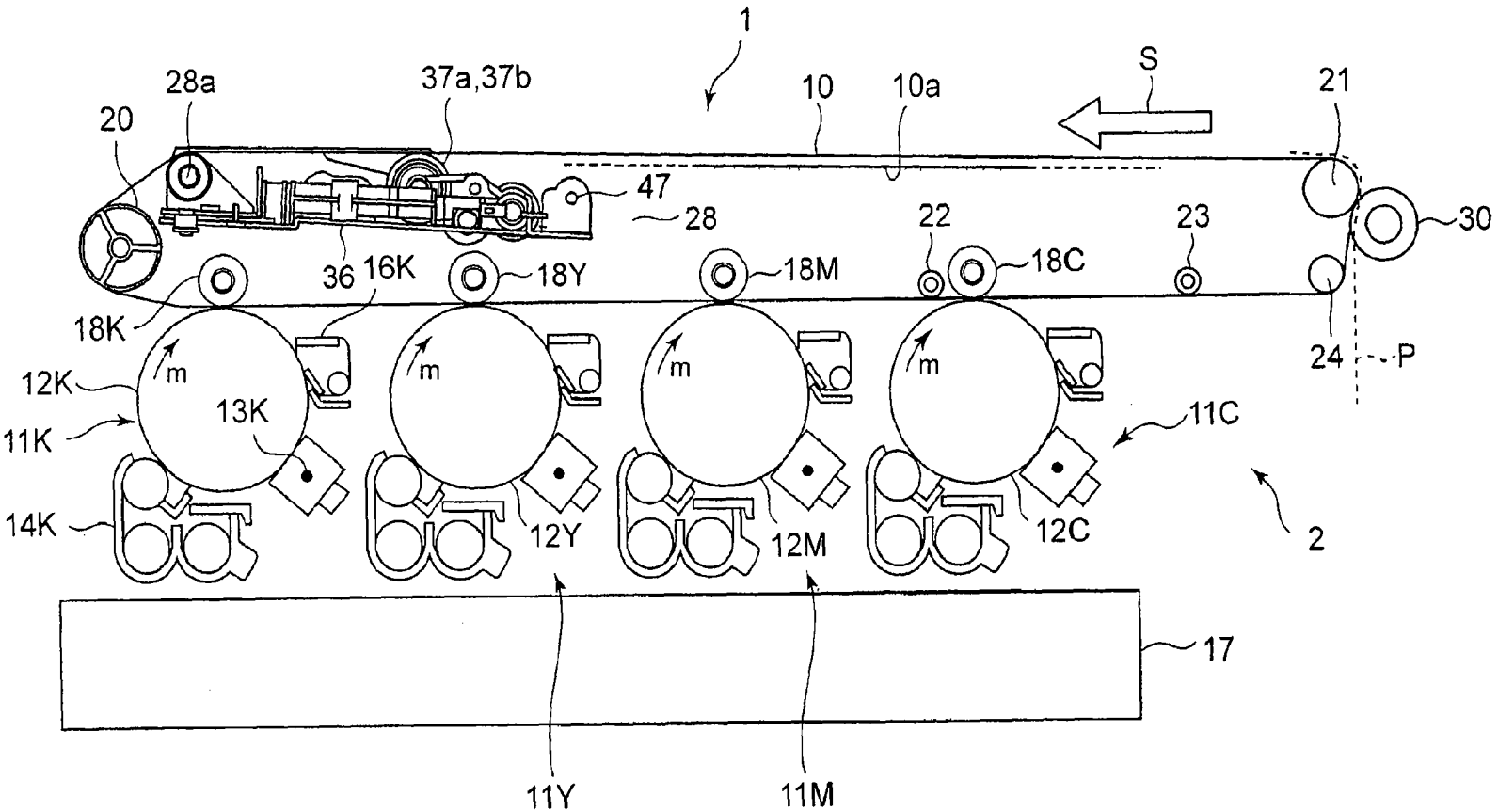
FIG. 1 is a schematic structural view showing a main part of a printer section according to a first embodiment of the invention.

Hereinafter, a first embodiment of the invention will be described in detail with reference to the accompanying drawings. FIG. 1 is a schematic structural view showing a main part of a printer section 2 of a four tandem type color image forming apparatus in which a transfer belt unit 1 of the first embodiment of the invention is installed. In the printer section 2, image formation stations 11K, 11Y, 11M and 11C of respective colors of black (K), yellow (Y), magenta (M) and cyan (C) are arranged in tandem along the lower side of a transfer belt 10 as a belt member rotated in an arrow s direction. The printer section 2 includes a laser exposure device 17. The laser exposure device 17 irradiates laser beams corresponding to image information to photoconductive drums 12K, 12Y, 12M and 12C of the image formation stations 11K, 11Y, 11M and 11C of the respective colors.

The image formation station 11K of black (K) of the printer section 2 includes a charger 13K, a developing device 14K, a transfer roller 18K and a cleaner 16K, which are arranged around the photoconductive drum 12K that rotates in a direction indicated by arrow m. Each of the image formation stations 11Y, 11M and 11C of the respective colors of yellow (Y), magenta (M) and cyan (C) has the same structure as the image formation station 11K of black (K). Each of transfer rollers 18Y, 18M and 18C are positioned opposite each of the image formation stations 11Y, 11M and 11C.

Figure 2:
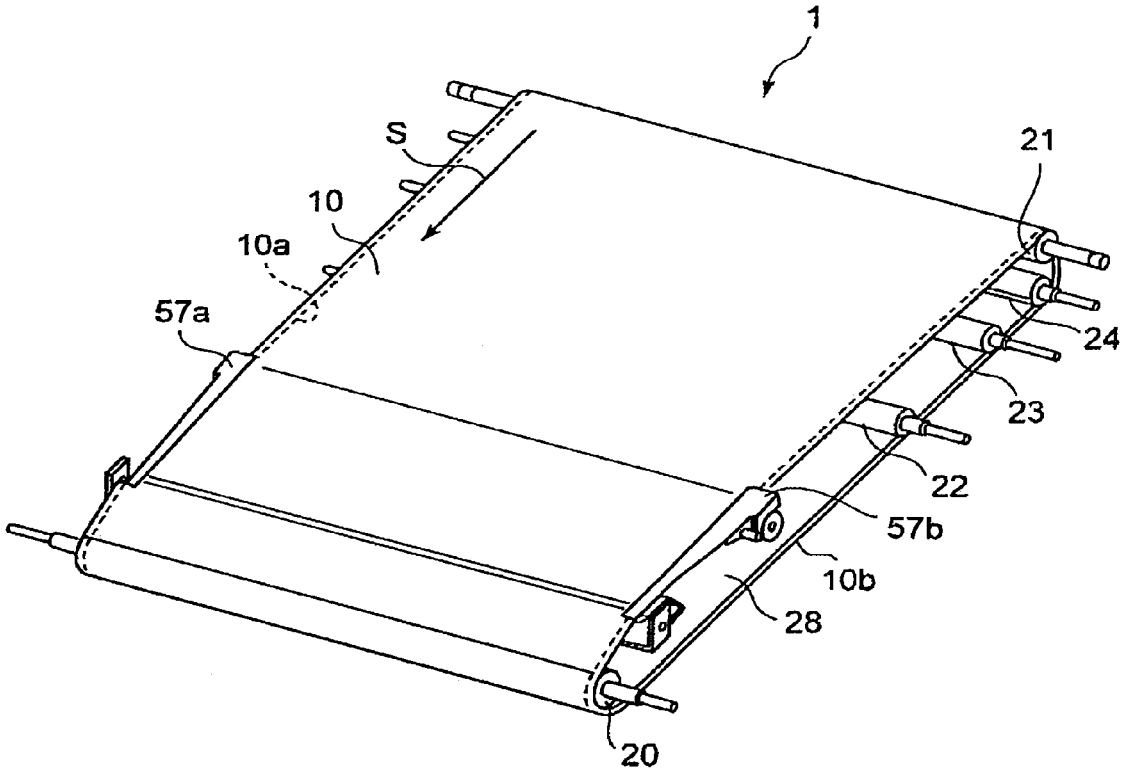
FIG. 2 is a schematic perspective view showing a transfer belt unit according to the first embodiment of the invention.
Figure 3:
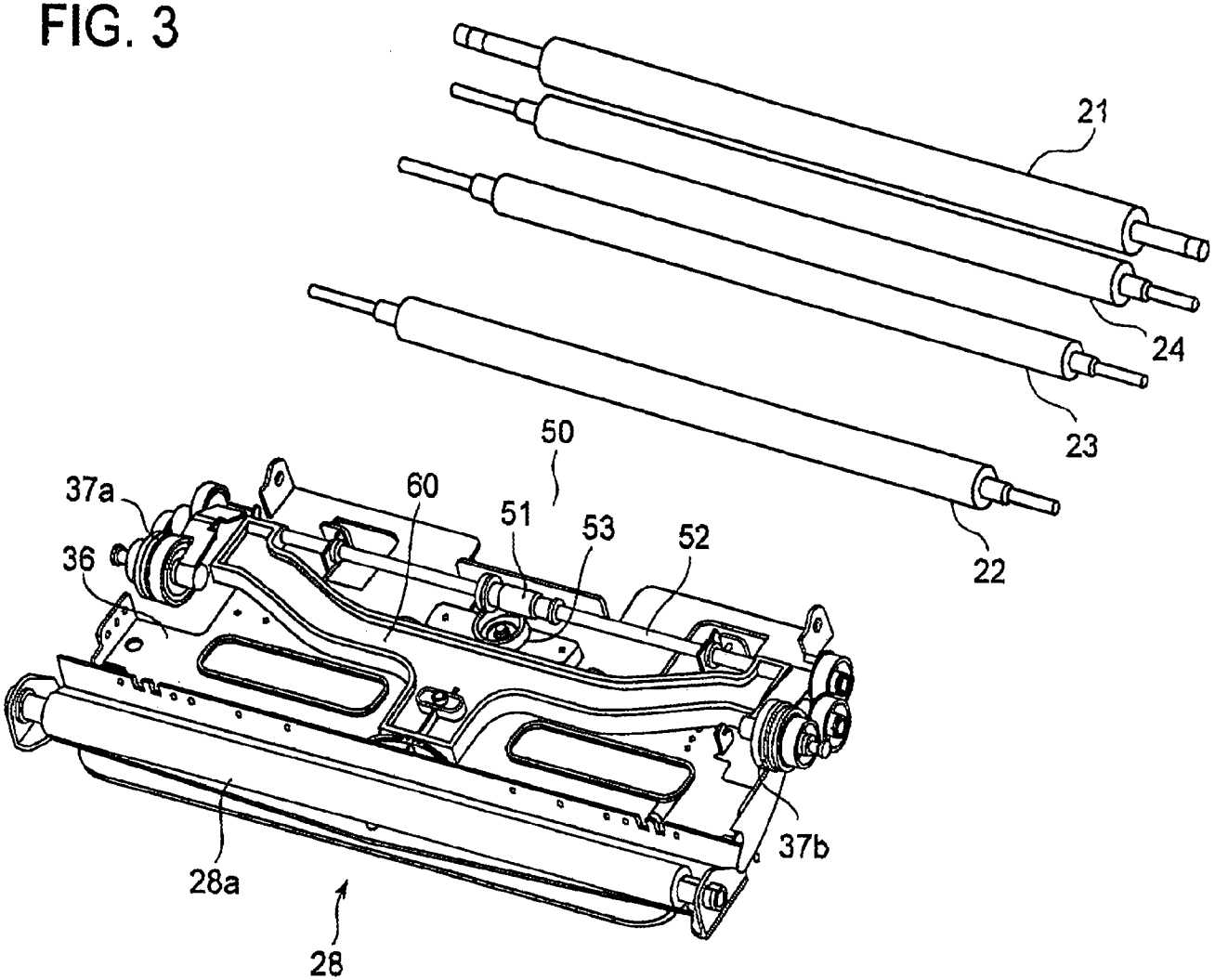
FIG. 3 is a schematic perspective view showing a state where a transfer belt of the transfer belt unit is removed according to the first embodiment of the invention.

A rib 10*a* is formed on an inner periphery at a rear side end as a first end of the transfer belt 10 of the transfer belt unit 1 in the width direction. A rib 10*b* is formed on the inner periphery at a front side end as a second end of the transfer belt 10. The ribs 10*a* and 10*b* are made of, for example, thin line-shaped rubber. As shown in FIG. 2 and FIG. 3, the transfer belt 10 is stretched by a drive roller 20, a driven roller 21 and first to third tension rollers 22 to 24. Further, the transfer belt 10 is stretched by a steering roller 28*a* of a self steering mechanism 28. A rear side detection roller 37*a* and a front side detection roller 37*b* of a self steering mechanism 28 are pressed to the transfer belt 10 without excessively applying tension to the transfer belt 10.

At a secondary transfer position where the transfer belt 10 is supported by the driven roller 21, a secondary transfer roller 30 is disposed to be opposite thereto. A transfer bias is supplied to the secondary transfer roller 30. At the secondary transfer position, a toner image on the transfer belt 10 is secondarily transferred to a sheet paper P or the like by the secondary transfer roller 30. Incidentally, the structure of the transfer belt unit 1 is not limited to this.

In the printer section 2, by a print operation start, the photoconductive drum 12K is rotated in the arrow m direction in the image formation station 11K of black (K). The photoconductive drum 12K is uniformly charged by the charger 13K as it rotates and is irradiated with an exposure light corresponding to image information by the laser exposure device 17, and an electrostatic latent image is formed. Thereafter, a toner image is formed on the photoconductive drum 12K by the developing device 14K. Further, the toner image on the photoconductive drum 12K is primarily transferred onto the transfer belt 10 rotating in the arrow s direction at the position of the transfer roller 18K. After the end of the primary transfer, residual toner on the photoconductive drum 12K is cleaned by the cleaner 16K, and next printing becomes possible.

Each of the image formation stations 11Y, 11M and 11C of the respective colors of yellow (Y), magenta (M) and cyan (C) performs the image formation operation similarly to the image formation station 11K of black (K). The respective toner images of yellow (Y), magenta (M) and cyan (C) formed by the image formation stations 11Y, 11M and 11C of the respective colors of yellow (Y), magenta (M) and cyan (C) are sequentially primarily transferred to the transfer belt 10. By this, a full color toner image made of multi-transferred toner images of black (K), yellow (Y), magenta (M) and cyan (C) is formed on the transfer belt 10.

The full color toner image superimposed on the transfer belt 10 reaches the secondary transfer position thereafter. The full color toner image is secondarily transferred onto the sheet paper P by the secondary transfer roller 30 at the secondary transfer position at once. The sheet paper P is fed to the secondary transfer position in synchronization with the arrival of the full color toner image on the transfer belt 10 at the secondary transfer position. Thereafter, the full color toner image transferred to the sheet paper P is fixed, the print image is completed, and the paper is ejected to a paper eject section.

Figure 4:
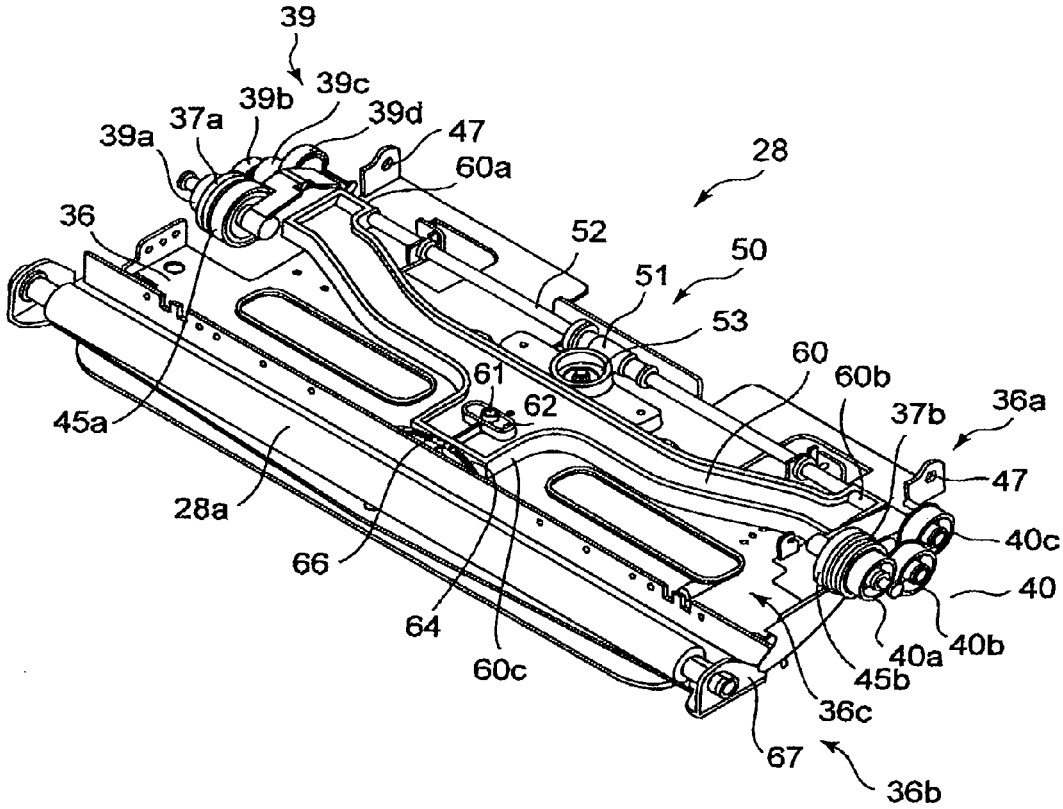
FIG. 4 is a schematic perspective view showing a self steering mechanism according to the first embodiment of the invention.
Figure 5:
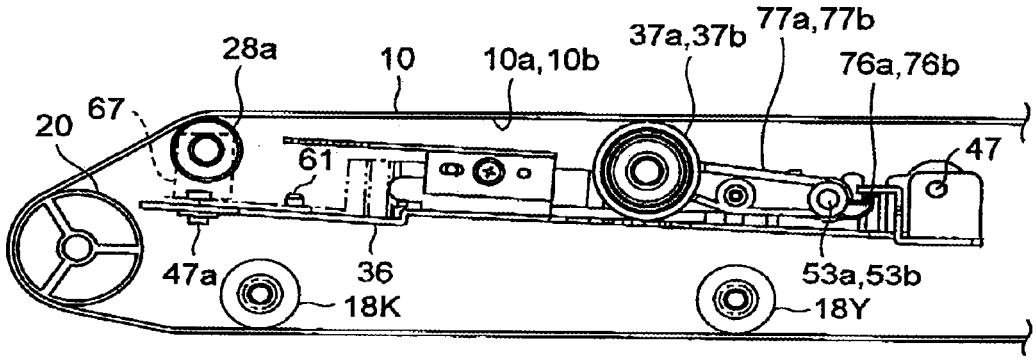
FIG. 5 is a schematic side view showing the self steering mechanism according to the first embodiment of the invention.
Figure 6:
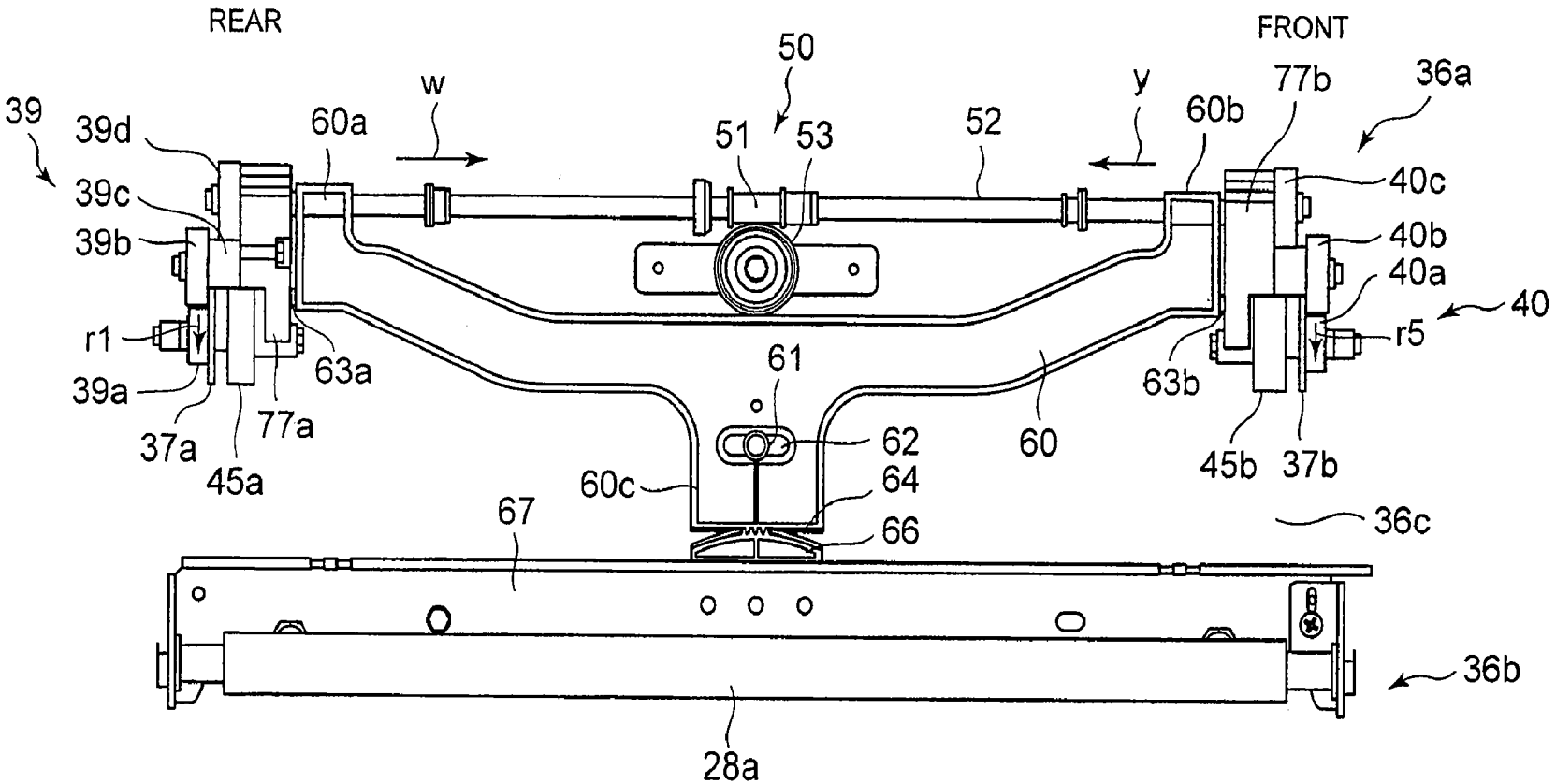
FIG. 6 is a schematic plan view showing the self steering mechanism according to the first embodiment of the invention.

Next, the self steering mechanism 28 will be described in detail. As shown in FIG. 4, FIG. 5 and FIG. 6, a support plate 36 as a support member supports a detection section 36*a*, a steering section 36*b* and a link section 36*c* as a transmission member. The detection section 36*a* includes the rear side detection roller 37*a* as a first detection roller to detect the meandering of the transfer belt 10, and the front side detection roller 37*b* as a second detection roller. The steering section 36*b* includes the steering roller 28*a*. The link section 36*c* transmits the rotation of the rear side detection roller 37*a* or the front side detection roller 37*b* to the steering roller 28*a*.

The support plate 36 rotates with respect to the main body of the printer section 2 while a fulcrum 47 is a rotation fulcrum. A spring 47*a* to push up the support plate is provided at the bottom of the support plate 36. The spring 47*a* pushes up the support plate 36, so that the steering roller 28*a* gives tension to the transfer belt 10. In this embodiment, although the support plate 36 is rotated and moved, the support plate 36 may be moved in parallel by a gondola type drive mechanism. The support plate 36 is moved in parallel and is pushed up, and the steering roller 28*a*, the rear side detection roller 37*a* and the front side detection roller 37*b* may be integrally pushed up to the transfer belt 10.

In the detection section 36*a*, the rear side detection roller 37*a* or the front side detection roller 37*b* is supported by a rear side support lever 77*a* or a front side support lever 77*b* as a first lever constituting the tensioner 74 as a tension member. One end of the rear side support lever 77*a* or the front side support lever 77*b* is fixed to a rear side lever fulcrum 53*a* or a front side lever fulcrum 53*b*. The rear side lever fulcrum 53*a* or the front side lever fulcrum 53*b* is coaxial to a linear movement shaft 52 as a shaft to coaxially support a worm 51 of a worm gear 50 as a conversion member, and is rotatably provided with respect to the linear movement shaft 52. The rear side lever fulcrum 53*a* or the front side lever fulcrum 53*b* is fixed to the support plate 36.

Figure 7:
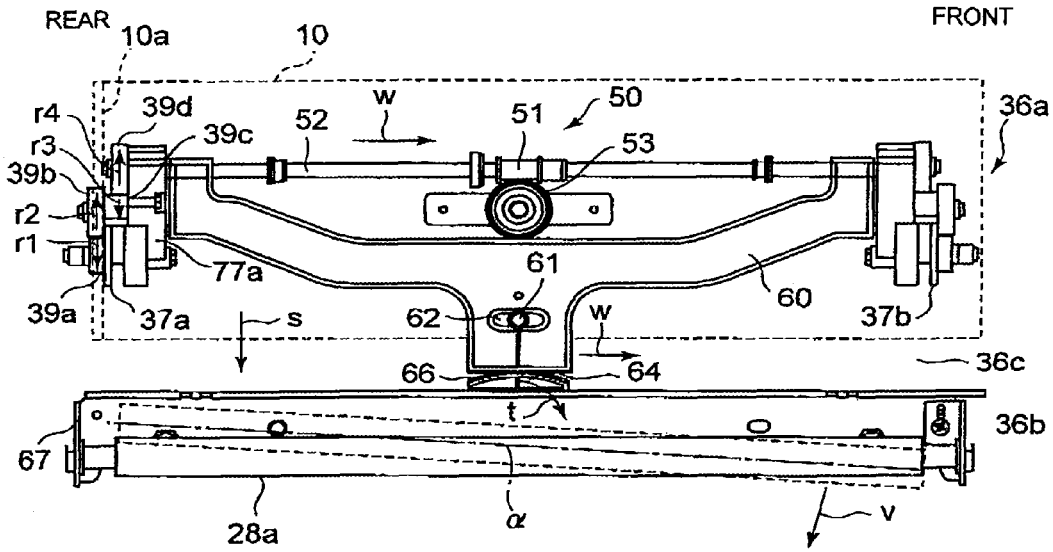
FIG. 7 is a schematic explanatory view showing the self steering mechanism when the transfer belt deviates to a front side according to the first embodiment of the invention.
Figure 8:
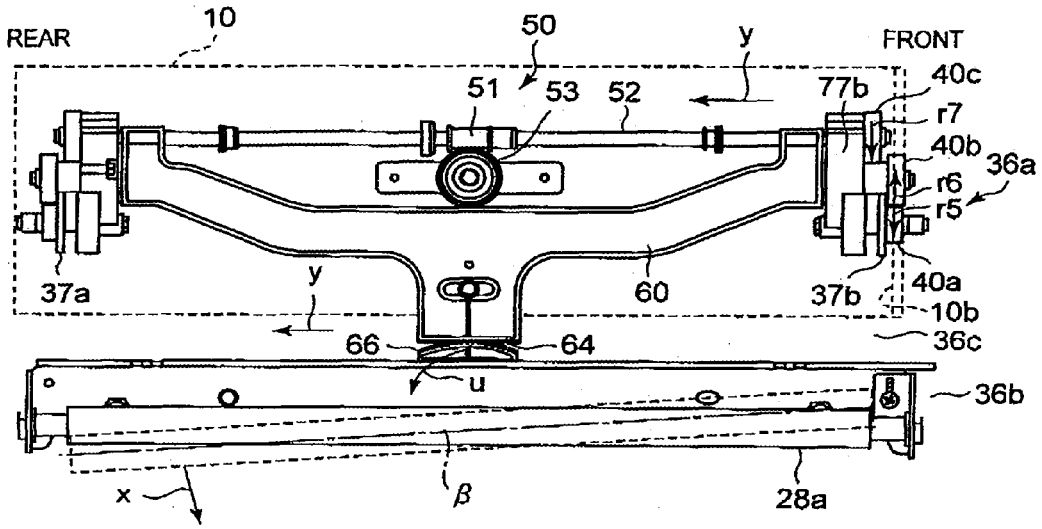
FIG. 8 is a schematic explanatory view showing the self steering mechanism when the transfer belt deviates to a rear side according to the first embodiment of the invention.

The rear side detection roller 37*a* or the front side detection roller 37*b* is rotatably supported by the rear side support lever 77*a* or the front side support lever 77*b*. When the transfer belt 10 is held at the normal position, the rear side detection roller 37*a* and the front side detection roller 37*b* are separated from the ribs 10*a* and 10*b* of the transfer belt 10. As shown in FIG. 7, when the transfer belt 10 meanders to the front, the rear side detection roller 37*a* contacts with the inside of the rear side rib 10*a*. By the contact with the rear side rib 10*a*, the rear side detection roller 37*a* is rotated in an arrow r1 direction. As shown in FIG. 8, when the transfer belt 10 meanders to the rear, the front side detection roller 37*b* contacts with the inside of the front side rib 10*b*. By the contact with the front side rib 10*b*, the front side detection roller 37*b* is rotated in an arrow r5 direction.

Figure 9:
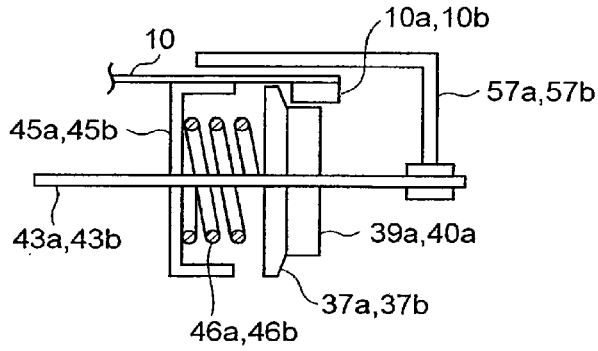
FIG. 9 is a schematic explanatory view showing a rear side compression spring or a front side compression spring according to the first embodiment of the invention.

As shown in FIG. 9, the rear side detection roller 37*a* is urged toward the rib 10*a* at the rear side end of the transfer belt 10 by the rear side compression spring 46*a* as the first urging member. The rear side compression spring 46*a* is supported by a rear side wheel 45*a* attached to a rear side shaft 43*a*. Similarly, the front side detection roller 37*b* is urged toward the rib 10*b* at the front side end of the transfer belt 10 by a front side compression spring 46*b* as the second urging member. The front side compression spring 46*b* is supported by a front side wheel 45*b* attached to a front side shaft 43*b*. Both the rear side compression spring 46*a* and the front side compression spring 46*b* have high elastic force. While the transfer belt unit 1 is being driven in the normal range, the rear side compression spring 46*a* and the front side compression spring 46*b* are not compressed by the deviation of the transfer belt 10. For example, at the time of abnormality when the color image forming apparatus is tilted, the transfer belt 10 is abruptly deviated, and when a large load is abruptly applied to the rear side detection roller 37*a* or the front side detection roller 37*b*, the compression spring is compressed. While the rear side compression spring 46*a* or the front side compression spring 46*b* is compressed at the time of abnormality, the load applied to the transfer belt 10 is reduced. While the compression spring 46*b* is compressed, the steering roller 28*a* is tilted and the deviation of the transfer belt 10 is corrected. Accordingly, damage of the transfer belt 10 at the time of abnormality can be prevented.

Figure 10:
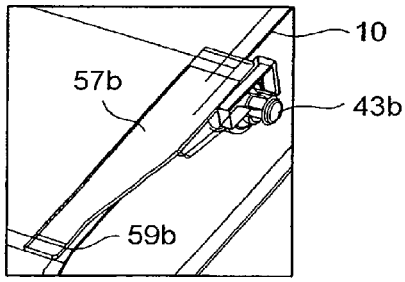
FIG. 10 is a schematic perspective view showing a state where a front side belt pressing member presses the transfer belt according to the first embodiment of the invention.
Figure 11:
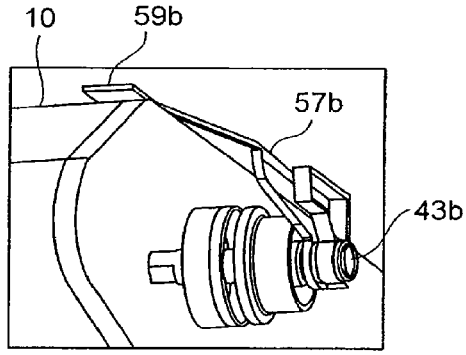
FIG. 11 is a schematic explanatory view showing an attachment state of the front side belt pressing member according to the first embodiment of the invention.

A rear side belt pressing member 57*a* or a front side belt pressing member 57*b*, as a pressing member, is attached to the rear side shaft 43*a* or the front side shaft 43*b*. FIG. 10 and FIG. 11 show the front side belt pressing member 57*b*. The front side belt pressing member 57*b* is rotatably attached to the front side shaft 43*b*. The front side belt pressing member 57*b* presses the front side of the transfer belt 10 by its own weight toward inner side of the transfer belt 10 to prevent the front side of the transfer belt 10 is waved. By this, the transfer belt 10 more certainly contacts with the front side detection roller 37*b*. A free end 59*b* of the front side belt pressing member 57*b* extends to a portion above the steering roller 28*a*. This prevents the free end 59*b* from biting into the transfer belt 10 at the time of rotation of the transfer belt 10. Incidentally, the rear side belt pressing member 57*a* is symmetrical to the front side belt pressing member 57*b* and has the same structure.

The rear side detection roller 37*a* includes a rear side gear unit 39 to transmit the rotation in the arrow r1 direction to the linear movement shaft 52. The front side detection roller 37*b* includes a front side gear unit 40 to transmit the rotation in the arrow r5 direction to the linear movement shaft 52. The rear side gear unit 39 includes a first rear gear 39*a*, a second rear gear 39*b*, a third rear gear 39*c* and a fourth rear gear 39*d*. The front side gear unit 40 includes a first front gear 40*a*, a second front gear 40*b* and a third front gear 40*c*. The fourth rear gear 39*d* separably contacts with the rear side support lever 77*a*. The third front gear 40*c* separably contacts with the front side support lever 77*b*. The linear movement shaft 52 rotates the worm 51 by the rotation of the fourth rear gear 39*d* and the third front gear 40*c*.

The worm 51 is engaged with the worm wheel 53 of the worm gear 50. The worm wheel 53 is not rotated but is fixed to the support plate 36 in a still state. The worm 51 is a left-hand screw, and when being rotated leftward viewed from the front side, the worm advances in an arrow y direction of FIG. 6 by the fixed worm wheel 53. When being rotated rightward viewed from the front side, the worm 51 advances in an arrow w direction of FIG. 6 by the fixed worm wheel 53.

The link member 36*c* includes a hanger-like slider 60. The slider 60 includes a slit 62 through which a fixed pin 61 provided on the support plate 36 is slidably inserted. The linear movement shaft 52 passes through a rear side branch 60*a* and a front side branch 60*b* of the slider 60. The linear movement shaft 52 is rotatable with respect to the rear side branch 60*a* and the front side branch 60*b*, and part of the weight of the slider 60 is loaded to the linear movement shaft 52.

The rear side branch 60*a* or the front side branch 60*b* is formed with a rear striking section 63*a* or a front striking section 63*b*. The rear side support lever 77*a* or the front side support lever 77*b* contacts with the rear striking section 63*a* or the front striking section 63*b*, and inward bending is prevented. The slider 60 is urged by the rear side support lever 77*a* or the front side support lever 77*b*, and is slid in the arrow w direction or the arrow y direction.

A rack 64 is formed at a center 60*c* of the slider 60. The rack 64 is engaged with a pinion 66 of the steering section 36*b*. The steering section 36*b* includes a steering support body 67 rotatable with respect to the support plate 36 and the steering roller 28*a* supported by the steering support body 67. The pinion 66 rotates the steering support body 67. By the rotation of the steering support body 67, the steering roller 28*a* supported by the steering support body 67 is tilted (moved to have an angle with respect to the roller shaft).

Figure 12:
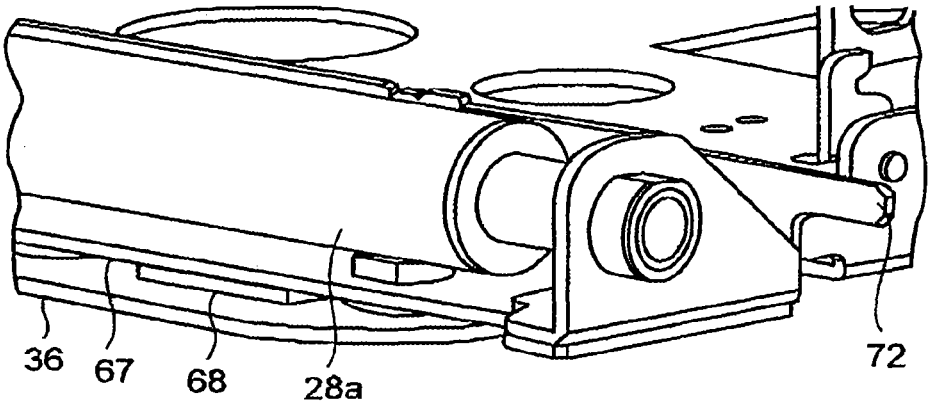
FIG. 12 is a schematic perspective view showing a state where an urethane foam plate is nipped between a support plate and a steering support body according to the first embodiment of the invention.

As shown in FIG. 12, a urethane foam plate 68 as an elastic member is nipped between the support plate 36 and the steering support body 67. The urethane foam plate 68 has a braking effect. The urethane foam plate 68 prevents the steering support body 67 from being overdriven to exceed an actually required tilt amount.

Figure 13:
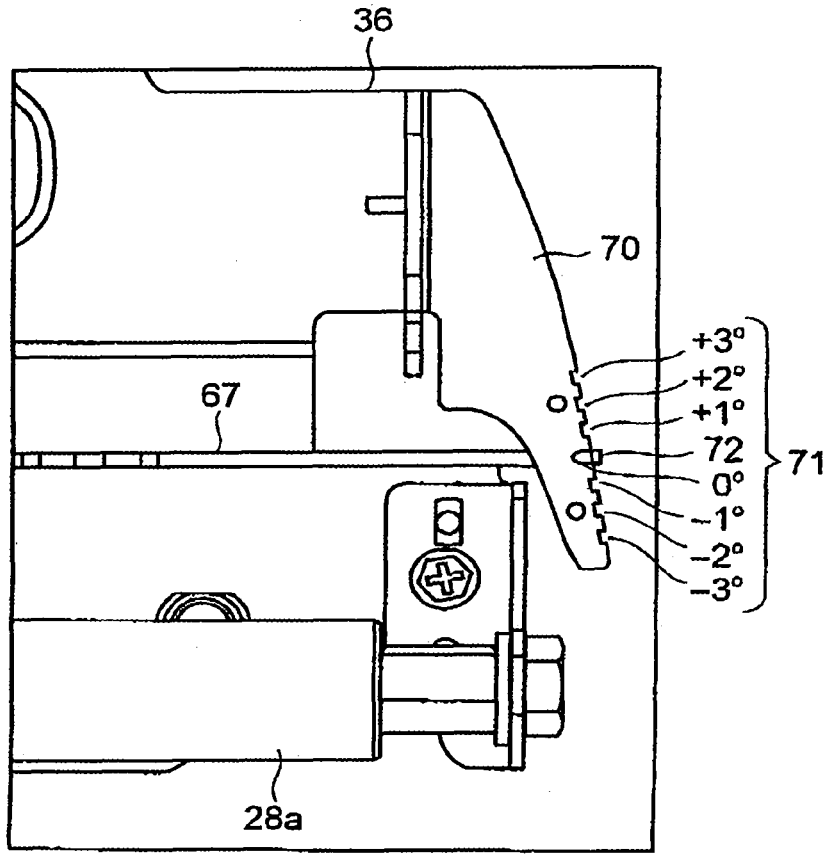
FIG. 13 is a schematic explanatory view showing an indicator according to the first embodiment of the invention.

As shown in FIG. 13, an indicator 70 as an indicating member is fixed to the support plate 36. The indicator 70 indicates a tilt angle as a movement amount of the steering roller 28*a* with respect to the support plate 36. The indicator 70 is given a mark 71 of 1° to 3° in ± directions with respect to 0°. The mark 71 indicates the position of a pointer 72 provided on the steering support body 67. The tilt angle of the steering roller 28*a* is recognized by reading the position of the pointer 72. For example, when the color image forming apparatus normally operates, the tilt angle of the steering roller 28*a* is ±2° or less.

Figure 14:
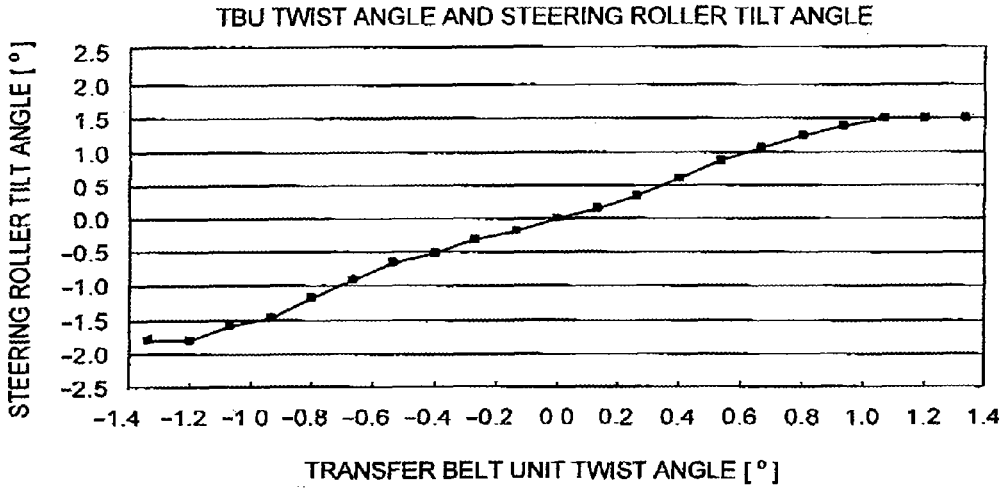
FIG. 14 is a graph showing a relation between a tilt angle of a steering roller and a twist angle of the transfer belt according to the first embodiment of the invention.

When a relation between the tilt angle of the steering roller 28*a* indicated by the indicator 70 and the twist angle of the transfer belt 10 is measured, for example, results shown in FIG. 14 are obtained. From FIG. 14, even if the twist angle of the transfer belt 10 increases in the ± direction, the tilt angle of the steering roller 28*a* falls within ±2°. Accordingly, when the tilt angle of the steering roller 28*a* exceeds ±2°, it is determined that an abnormality occurs in the transfer belt 10 or the color image forming apparatus.

Figure 15:
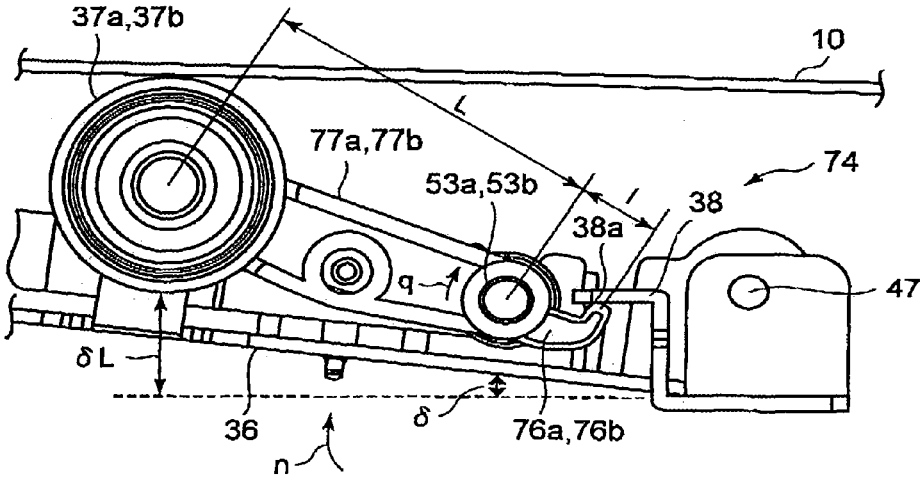
FIG. 15 is a schematic explanatory view showing a tensioner according to the first embodiment of the invention.

Next, the tensioner 74 as the tension member will be described. The tensioner 74 moves the rear side detection roller 37*a* and the front side detection roller 37*b* to a contact area with the transfer belt 10 at the rotation of the support plate 36. The contact area with the transfer belt 10 is [[a]] an area which the transfer belt 10 contacts the rib 10*a* at the rear side detection roller 37*a* or the rib 10*a* at the front side detection roller 37*b* when the transfer belt 10 meanders. As shown in FIG. 15, the tensioner 74 includes the rear side support lever 77*a* or the front side support lever 77*b*, which is a first lever, fixed to the rear side lever fulcrum 53*a* or the front side lever fulcrum 53*b* respectively. The tensioner 74 includes a rear side reference lever 76*a* or a front side reference lever 76*b*, which is a second lever, fixed to the rear side lever fulcrum 53*a* or the front side lever fulcrum 53*b* respectively.

The other end of the rear side reference lever 76*a* or the front side reference lever 76*b* contacts with a bracket 38 fixed to the main body side of the printer section 2, and the movement is regulated. When the support plate 36 is rotated in an arrow n direction, the rear side reference lever 76*a* or the front side reference lever 76*b* regulated by the bracket 38 rotates the rear side lever fulcrum 53*a* or the front side lever fulcrum 53*b* in an arrow q direction respectively. The rear side support lever 77*a* or the front side support lever 77*b* fixed to the rear side lever fulcrum 53*a* or the front side lever fulcrum 53*b* rotates together with the rear side lever fulcrum 53*a* or the front side lever fulcrum 53*b* respectively.

When the length from the center of the rear side lever fulcrum 53*a* or the front side lever fulcrum 53*b* to a contact position 38*a* between the other end of the rear side reference lever 76*a* or the front side reference lever 76*b* and the bracket 38 is made 1, the length from the center of the rear side lever fulcrum 53*a* or the front side lever fulcrum 53*b* to the rear side detection roller 37*a* or the front side detection roller 37*b* is set to L. When the support plate 36 is rotated in the arrow n direction and when the movement distance of the rear side lever fulcrum 53*a* or the front side lever fulcrum 53*b* is δ, the movement distance of the rear side detection roller 37*a* or the front side detection roller 37*b* becomes δL.

Figure 16:
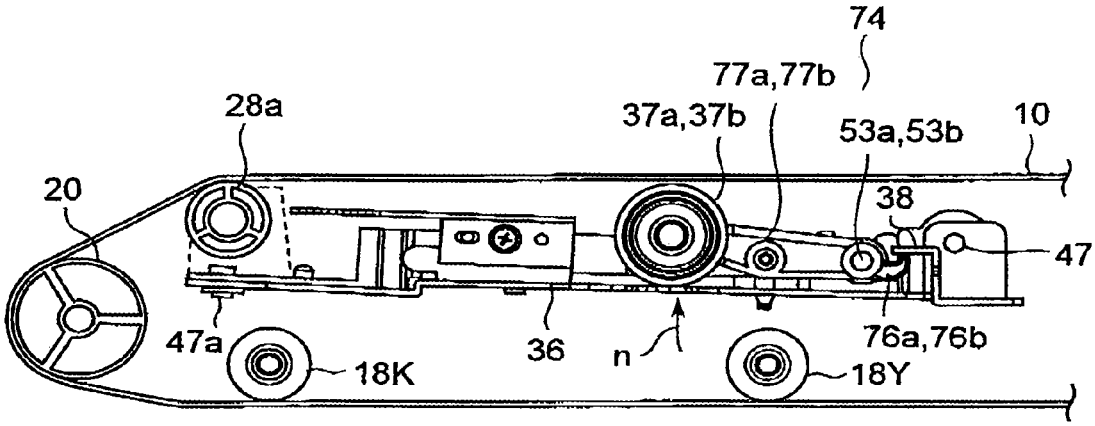
FIG. 16 is a schematic explanatory view showing a movement amount of a rear side detection roller or a front side detection roller when rotation of a support plate is small according to the first embodiment of the invention.

FIG. 16 shows a case where the peripheral length of the transfer belt 10 is short and the rotation amount of the support plate 36 in the arrow n direction is small. At this time, the rear side detection roller 37*a* or the front side detection roller 37*b* arrive in the contact area with the transfer belt 10 by small moving distance. The rear side detection roller 37*a* or the front side detection roller 37*b* is pressed to the ribs 10*a* and 10*b* of the transfer belt 10 without excessively applying tension to the transfer belt 10. By this, the rear side detection roller 37*a* or the front side detection roller 37*b* can certainly detect the deviation of the transfer belt 10.

Figure 17:
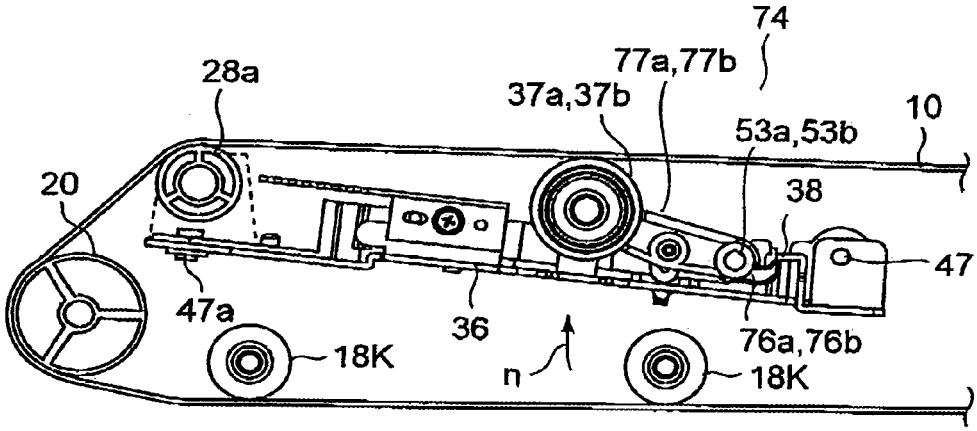
FIG. 17 is a schematic explanatory view showing the movement amount of the rear side detection roller or the front side detection roller when the rotation of the support plate is large according to the first embodiment of the invention.

FIG. 17 shows a case where the peripheral length of the transfer belt 10 is long and the rotation distance of the support plate 36 in the arrow n direction is large. At this time, the rear side detection roller 37*a* or the front side detection roller 37*b* is separated from the contact area with the transfer belt 10 unless it is moved much. However, since the movement of the rear side detection roller 37*a* or the front side detection roller 37*b* is set to be L times larger than the movement distance of the rear side lever fulcrum 53*a* or the front side lever fulcrum 53*b*, the rear side detection roller 37*a* or the front side detection roller 37*b* can be move to the contact area with the transfer belt 10. By this, the rear side detection roller 37*a* or the front side detection roller 37*b* can certainly detect the deviation of the transfer belt 10.

Incidentally, when the length to the rear side reference lever 76*a* or the front side reference lever 76*b* is made 1, the length L to the rear side detection roller 37*a* or the front side detection roller 37*b* is not limited. The length L is set within the range where when the support plate 36 is rotated, the rear side detection roller 37*a* or the front side detection roller 37*b* can detect the deviation of the transfer belt 10.

Next, the operation of the self steering mechanism 28 will be described. While the print operation is being performed in the printer section 2, when the transfer belt 10 does not meander but rotates and travels at the normal position, the self steering mechanism 28 is not actuated. On the other hand, while the print operation is being performed, when the transfer belt 10 meanders, the self steering mechanism 28 detects the meandering of the transfer belt 10. By the detection of the meandering of the transfer belt 10, the steering roller 28*a* is tilted, and the traveling direction of the transfer belt 10 is corrected.

For example, the tilting of the steering roller 28*a* when the transfer belt 10 meanders to the front will be described with reference to FIG. 7. Incidentally, the rotation direction of each gear described here is the rotation direction viewed from the front side. (1) When the transfer belt 10 traveling in the arrow s direction deviates to the front side, the inside of the rear side rib 10*a* of the transfer belt 10 contacts with the rear side detection roller 37*a*. (2) By contacts with the rear side rib 10*a*, the rear side detection roller 37*a* of the detection section 36*a* is rotated with the rear side rib 10*a* and rotates left (r1).

(3) The rotation of the rear side detection roller 37*a* is transmitted to the rear side gear unit 39, the linear movement shaft 52 and the slider 60, and tilts the steering roller 28*a*. By the rotation of the rear side detection roller 37*a*, the coaxial first rear gear 39*a* rotates left (r1), the second rear gear 39*b* rotates right (r2), the third rear gear 39*c* rotates left (r3), and the fourth rear gear 39*d* rotates right (r4). By right rotation (r4) of the second rear gear 39*b*, the linear movement shaft 52 connected to the fourth rear gear 39*d* rotates right (r4). By the right rotation (r4) of the linear movement shaft 52, the worm 51 rotates right. The worm 51 is engaged with the fixed worm wheel 53, and linearly moves the linear movement shaft 52 in the arrow w direction.

(4) By linear movement in the arrow w direction of the linear movement shaft 52, the slider 60 is pushed by the rear side support lever 77*a*, and is slid in the arrow w direction. (5) When the rack 64 of the slider 60 is slid in the arrow w direction, the pinion 66 is rotated in the arrow t direction. (6) By the rotation of the pinion 66 in the arrow t direction, the steering support body 67 and the steering roller 28*a* supported by the steering support body 67 are tilted in an arrow v direction. As indicated by a dotted line in FIG. 7, a force to convey the belt in the direction orthogonal to the axial line α of the tilted steering roller 28*a* is generated for the transfer belt 10. By this, the traveling direction is corrected so that the transfer belt 10 deviates to the rear side.

Incidentally, although the angle of the tiling of the steering roller 28*a* for correcting the traveling direction of the transfer belt 10 is nor limited, in this embodiment, it is assumed that for example, even when the transfer belt 10 is shifted by ±1 mm from the center in design, the traveling direction can be corrected to the normal direction by tilting the steering roller 28*a* by ±3° at the maximum.

Besides, when the steering support body 67 and the steering roller 28*a* are tilted in the arrow v direction, the steering support body 67 is immediately stopped at a desired tilt angle by the braking effect of the urethane foam plate 68. The steering support body 67 and the steering roller 28*a* can correct the direction of the transfer belt 10 at high speed without being overdriven on the support plate 36.

When the traveling direction of the transfer belt 10 is corrected to the normal direction by the tilting of the steering roller 28*a*, the rear side rib 10*a* of the transfer belt 10 is separated from the rear side detection roller 37*a*, and the rear side detection roller 37*a* is stopped. However, after the rotation of the steering roller 28*a*, a time lag occurs before the traveling direction of the transfer belt 10 is corrected. During the time lag, when the rear side detection roller 37*a* is rotated, the rotation amount of the steering roller 28*a* becomes excessive. As a result, the transfer belt 10 deviates to the rear side. Thus, when the rear side detection roller 37*a* is rotated, by using the rotation of the rear side detection roller 37*a*, the rear side detection roller 37*a* is moved to be separated from the transfer belt 10. That is, before the traveling direction of the transfer belt 10 is corrected by the steering roller 28*a*, the rear side detection roller 37*a* can be separated from the transfer belt 10. As a result, it is prevented that the rotation amount of the steering roller 28*a* becomes excessive.

Figure 18:
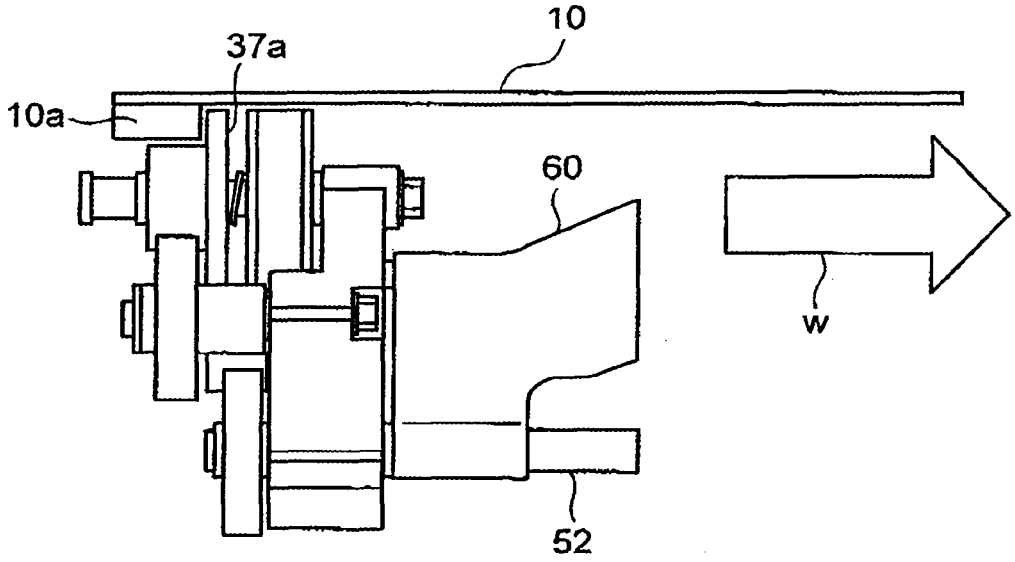
FIG. 18 is a schematic explanatory view showing rotation of the rear side detection roller by a rear side rib according to the first embodiment of the invention.
Figure 19:
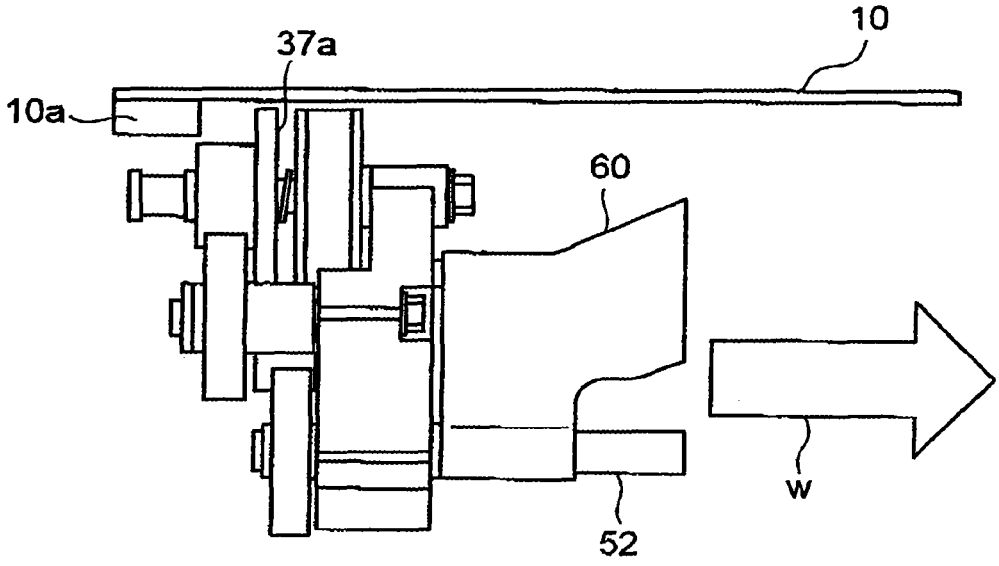
FIG. 19 is a schematic explanatory view showing a state where the rear side rib is separated from the rear side detection roller by movement of a linear movement shaft according to the first embodiment of the invention.

When the rear side detection roller 37*a* rotates left (r1), as described above, the linear movement shaft 52 is moved in the arrow w direction (shown in FIG. 18). By linear movement in the arrow w direction of the linear movement shaft 52, the rear side detection roller 37*a* is separated from the rear side rib 10*a* of the transfer belt 10. As shown in FIG. 19, when the rear side rib 10*a* of the transfer belt is separated, the rear side detection roller 37*a* is stopped. However, when the tilting of the steering roller 28*a* is insufficient, the rear side rib 10*a* again contacts with the rear side detection roller 37*a*. By this, the rear side detection roller 37*a* is again rotated and further tilts the steering roller 28*a*. Besides, as the rear side detection roller 37*a* is separated from the rear side rib 10*a*, the contact force of the rear side rib 10*a* to the rear side detection roller 37*a* becomes small. By this, the rotation amount of the rear side detection roller 37*a* is decreased. The rotation and stop of the rear side detection roller 37*a* are repeated, so that the traveling direction of the transfer belt 10 is corrected, the meandering is regulated, and the stable rotation and traveling are performed.

Next, the tilting of the steering roller 28*a* when the transfer belt 10 meanders to the rear will be described with reference to FIG. 8. Incidentally, the rotation direction of each gear described here is the rotation direction viewed from the front side. (1) When the transfer belt 10 traveling in the arrow s direction deviates to the rear side, the inside of the front side rib 10*b* of the transfer belt 10 contacts with the front side detection roller 37*b*. (2) By contacts with the front side rib 10*b*, the front side detection roller 37*b* of the detection section 36*a* is rotated with the front side rib 10*b* and rotates left (r5).

(3) The rotation of the front side detection roller 37*b* is transmitted to the front side gear unit 40, the linear movement shaft 52 and the slider 60, and tilts the steering roller 28*a*. By the rotation of the front side detection roller 37*b*, the coaxial first front gear 40*a* rotates left (r5), the second front gear 40*b* rotates right (r6), and the third front gear 40*c* rotates left (r7). By left rotation (r7) of the third front gear 40*c*, the linear movement shaft 52 connected to the third front gear 40*c* rotates left (r7). By the left rotation (r7) of the linear movement shaft 52, the worm 51 rotates left. The worm 51 is engaged with the fixed worm wheel 53, and linearly moves the linear movement shaft 52 in the arrow y direction.

(4) By linear movement in the arrow y direction of the linear movement shaft 52, the slider 60 is pushed by the front side support lever 77*b*, and is slid in the arrow y direction. (5) When the rack 64 of the slider 60 is slid in the arrow y direction, the pinion 66 is rotated in an arrow u direction. (6) By the rotation of the pinion 66 in the arrow u direction, the steering support body 67 and the steering roller 28*a* supported by the steering support body 67 are tilted in an arrow x direction. As indicated by a dotted line in FIG. 8, a force to convey the belt in the direction orthogonal to the axial line β of the tilted steering roller 28*a* is generated for the transfer belt 10. By this, the traveling direction is corrected so that the transfer belt 10 deviates to the front.

Besides, at this time, when the front side detection roller 37*b* rotates left (r5) by the transfer belt 10, as described above, the linear movement shaft 52 is moved in the arrow y direction. By this, the front side detection roller 37*b* is separated from the front side rib 10*b* of the transfer belt 10. Thereafter, similarly to the time of the rotation of the rear side detection roller 37*a*, the rotation and stop of the front side detection roller 37*b* are repeated, and the traveling direction of the transfer belt 10 is corrected.

At the correction of the traveling direction of the transfer belt 10, when the tension of the transfer belt 10 is changed, the support plate 36 is swayed. By this, the steering roller 28*a* gives suitable tension to the transfer belt 10. At the same time as this, the tensioner 74 moves the rear side detection roller 37*a* and the front side detection roller 37*b*, respectively, by required distances. By this, the rear side detection roller 37*a* and the front side detection roller 37*b* can contact with the transfer belt 10.

Besides, at the correction of the traveling direction of the transfer belt 10, the transfer belt 10 is pressed by the rear side belt pressing member 57*a* or the front side belt pressing member 57*b*. By this, the rear side end and the front side end of the transfer belt 10 are urged to inner side of the transfer belt 10. Accordingly, when the transfer belt 10 deviates, the rear side rib 10*a* or the front side rib 10*b* can more certainly contact with the rear side detection roller 37*a* or the front side detection roller 37*b*.

While the print operation is performed, the indication of the indicator 70 is confirmed at specified intervals. From the indication of the indicator 70, when the tilt angle of the steering roller 28*a* falls within ±2°, it is determined that the normal operation is performed. When the tilt angle of the steering roller 28*a* exceeds ±2°, it is determined that an abnormality occurs in the transfer belt 10 or in the inside of the color image forming apparatus, and the operation is interrupted.

While the print operation is being performed, when the transfer belt 10 is abruptly deviated, a large load is abruptly applied between the rear side detection roller 37*a* and the rear side rib 10*a* or between the front side detection roller 37*b* and the front side rib 10*b*. However, at this time, the rear side compression spring 46*a* or the front side compression spring 46*b* is compressed, and the rear side detection roller 37*a* or the front side detection roller 37*b* is moved in the direction of separating from the rear side rib 10*a* or the front side rib 10*b*. By this, the load applied to the transfer belt 10 by the abrupt deviation is reduced. Further, while the rear side compression spring 46*a* or the front side compression spring 46*b* is compressed, the steering roller 28*a* is tilted, the deviation of the transfer belt 10 is corrected, and the load applied to the transfer belt 10 is reduced. By this, even when there occurs an abnormality that the transfer belt 10 is abruptly deviated, the damage of the transfer belt 10 can be prevented.

According to the first embodiment, the meandering of the transfer belt 10 is detected by the rear side detection roller 37*a* or the front side detection roller 37*b* that contacts with the rib 10*a* or 10*b* of the transfer belt 10. The rotation of the rear side detection roller 37*a* or the front side detection roller 37*b* is converted into the linear driving by using the worm gear 50, and the linear movement shaft 52 is linearly moved. The linear driving of the linear movement shaft 52 is transmitted to the steering roller 28*a* through the slider 60, and the steering roller 28*a* is tilted. By the tilting of the steering roller 28*a*, the direction of the rotation traveling of the transfer belt 10 is corrected.

Further, the rotation of the rear side detection roller 37*a* or the front side detection roller 37*b* is converted into the linear movement of the linear movement shaft 52 by the worm gear 50, and the rear side detection roller 37*a* or the front side detection roller 37*b* is separated from the rib 10*a* or 10*b* of the transfer belt 10. Accordingly, the meandering of the transfer belt can be easily and certainly regulated without requiring expensive and complicated control or mechanism. As a result, the damage of the transfer belt is prevented, the transfer belt can be stably rotated and traveled, and an excellent transfer image can be obtained.

Next, a second embodiment of the invention will be described. The second embodiment is different from the first embodiment in the structure of a transfer belt, and detection of meandering of the transfer belt is reversed between a rear side and a front side. Accordingly, in this second embodiment, a screw of a worm of a worm gear is opposite to that of the first embodiment. In this second embodiment, the same structure as the structure described in the first embodiment is denoted by the same reference numeral and its detail explanation will be omitted.

In a self steering mechanism 81 of the second embodiment, a transfer belt 80 does not have a rib at both ends of an inner periphery. When the transfer belt 80 is held at a normal position, both ends of the transfer belt 80 are separated from a rear side detection roller 82*a* and a front side detection roller 82*b*. When the transfer belt 80 meanders and contacts with a roller surface of the rear side detection roller 82*a* or the front side detection roller 82*b*, the rear side detection roller 82*a* or the front side detection roller 82*b* is rotated. The rotation amount of the rear side detection roller 82*a* or the front side detection roller 82*b* is adjusted by a contact area between the transfer belt 80 and the roller surface. Accordingly, the width of the roller surface of the rear side detection roller 82*a* or the front side detection roller 82*b* is formed to be larger than at least the width corresponding to the maximum meandering amount of the transfer belt 80.

Figure 20:
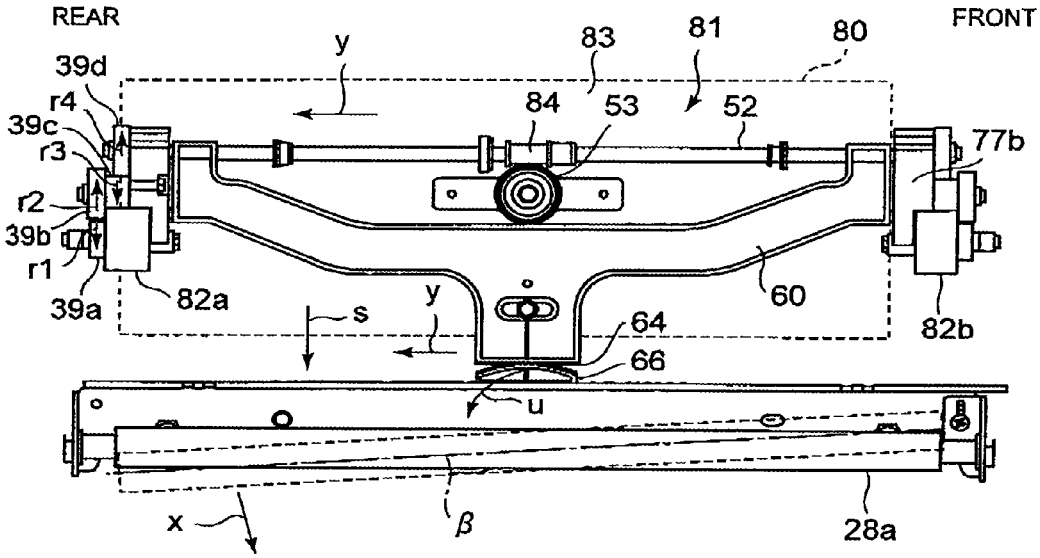
FIG. 20 is a schematic explanatory view showing a self steering mechanism when a transfer belt deviates to a rear side according to a second embodiment of the invention.

In the second embodiment, it is assumed that a worm 84 engaging with a worm wheel 53 of a worm gear 83 is a right-hand screw. When the worm 84 rotates right viewed from the front side, the worm advances in an arrow y direction of FIG. 20 by the fixed worm wheel 53.

Next, the operation of the self steering mechanism 81 will be described. Incidentally, the rotation direction of each gear described here is the rotation direction viewed from the front side. When the transfer belt 80 does not meander but is rotated and traveled at the normal position, the self steering mechanism 81 is not operated. When the transfer belt 80 traveling in an arrow s direction meanders to the rear, (1) the inner periphery of the transfer belt 80 at the rear side end contacts with the roller surface of the rear side detection roller 82*a*. (2) By this, the rear side detection roller 82*a* is rotated with the transfer belt 80 and rotates left (r1). (3) By the rotation of the rear side detection roller 82*a*, a coaxial first rear gear 39*a* rotates left (r1), a second rear gear 39*b* rotates right (r2), a third rear gear 39*c* rotates left (r3), and a fourth rear gear 39*d* rotates right (r4). By this, a linear movement shaft 52 connected to the fourth rear gear 39*d* rotates right (r4). By the right rotation (r4) of the linear movement shaft 52, the worm 84 rotates right. Since the worm 84 is the right-hand screw, the worm is engaged with the fixed worm wheel 53 and linearly moves the linear movement shaft 52 in the arrow y direction.

(4) By linear movement in the arrow y direction of the linear movement shaft 52, a slider 60 is pushed by a front side support lever 77*b* and is slid in the arrow y direction. (5) When a rack 64 of the slider 60 is slid in the arrow y direction, a pinion 66 is rotated in an arrow u direction. (6) By the rotation of the pinion 66 in the arrow u direction, a steering support body 67 and a steering roller 28*a* supported by this are tilted in the arrow x direction. As indicated by a dotted line in FIG. 20, a force to convey the belt in the direction orthogonal to the axial line β of the steering roller 28*a* is generated for the transfer belt 80. By this, the traveling direction is corrected so that the transfer belt 80 deviates to the front.

When the rear side detection roller 82*a* rotates left (r1), the linear movement shaft 52 is moved in the arrow y direction. By this, the rear side detection roller 82*a* is separated from the transfer belt 80. When the rear side of the transfer belt 80 is separated, the rear side detection roller 82*a* is stopped. This prevents the rotation amount of the steering roller 28*a* from becoming excessive. However, when the tilting of the steering roller 28*a* is insufficient, the transfer belt 80 again contacts with the rear side detection roller 82*a*. By this, the rear side detection roller 82*a* is again rotated, and further tilts the steering roller 28*a*. Besides, as the rear side detection roller 82*a* is separated from the transfer belt 80, the contact force of the transfer belt 80 to the rear side detection roller 82*a* becomes small. By this, the rotation amount of the rear side detection roller 82*a* is decreased. The rotation and stop of the rear side detection roller 82*a* are repeated, so that the traveling direction of the transfer belt 80 is corrected, the meandering is regulated and the stable rotation and traveling are performed.

Figure 21:
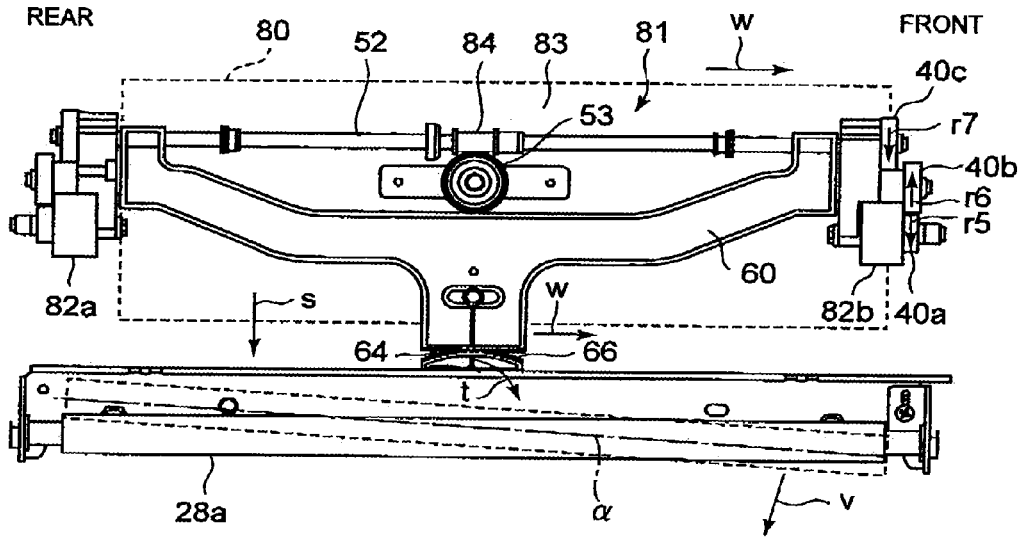
FIG. 21 is a schematic explanatory view showing the self steering mechanism when the transfer belt deviates to a front side according to the second embodiment of the invention.

As shown in FIG. 21, when the transfer belt 80 meanders to the front, (1) the inner periphery of the transfer belt 80 at the front side end contacts with the roller surface of the front side detection roller 82*b*. (2) By this, the front side detection roller 82*b* is rotated with the transfer belt 80 and rotates left (r5). (3) By the rotation of the front side detection roller 82*b*, a coaxial first front gear 40*a* rotates left (r5), a second front gear 40*b* rotates right (r6), and a third front gear 40*c* rotates left (r7). By this, the linear movement shaft 52 connected to the third front gear 40*c* rotates left (r7). The worm 84 rotates left by the left rotation (r7) of the linear movement shaft 52. Since the worm 84 is the right-hand screw, the worm is engaged with the fixed worm wheel 53 and linearly moves the linear movement shaft 52 in an arrow w direction.

(4) By linear movement in the arrow w direction of the linear movement shaft 52, the slider 60 is pushed by the rear side support lever 77*a* and is slid in the arrow w direction. (5) When the rack 64 of the slider 60 is slid in the arrow w direction, the pinion 66 rotates in an arrow t direction. (6) By the rotation of the pinion 66 in the arrow t direction, the steering support body 67 and the steering roller 28*a* supported by this are tilted in an arrow v direction. As indicated by a dotted line in FIG. 21, a force to convey the belt in the direction orthogonal to the axial line α of the tilted steering roller 28*a* is generated for the transfer belt 80. By this, the traveling direction is corrected so that the transfer belt 80 deviates to the rear.

When the front side detection roller 82*b* rotates left (r5), the linear movement shaft 52 is moved in the arrow w direction. By this, the front side detection roller 82*b* is separated from the transfer belt 80. When the rear side of the transfer belt 80 is separated, the front side detection roller 82*b* is stopped. This presents the rotation amount of the steering roller 28*a* from becoming excessive. However, when the tilting of the steering roller 28*a* is insufficient, the transfer belt 80 again contacts with the front side detection roller 82*b*. By this, the front side detection roller 82*b* is again rotated and further rotates the steering roller 28*a*. Besides, as the front side detection roller 82*b* is separated from the transfer belt 80, the contact force of the transfer belt 80 to the front side detection roller 82*b* becomes small. By this, the rotation amount of the front side detection roller 82*b* is decreased. The rotation and stop of the front side detection roller 82*b* are repeated, so that the traveling direction of the transfer belt 80 is corrected, the meandering is regulated, and the stable rotation and traveling are performed.

According to the second embodiment, similarly to the first embodiment, the meandering of the transfer belt 80 can be easily and certainly regulated. Accordingly, the transfer belt 80 is stably rotated and traveled without damaging the transfer belt 80, and an excellent transfer image can be obtained. Further, it is not necessary to form an expensive rib on the transfer belt 80, and the cost of the transfer belt 80 can be reduced.

Incidentally, in this embodiment, although the material of the roller surface of the rear side detection roller or the front side detection roller is not limited, it may be made of a material having a large friction coefficient, such as rubber. By doing so, a sufficient friction force can be ensured between the rear side detection roller or the front side detection roller and the inner periphery of the transfer belt. As a result, the rear side detection roller or the front side detection roller can accurately detect the meandering of the transfer belt, and the traveling direction of the transfer belt can be more certainly corrected.

Incidentally, the invention is not limited to the above embodiments, but can be variously modified within the scope of the invention. For example, with respect to the material of the first detection roller or the second detection roller, as long as the roller can be rotated by the contact with the belt member, its structure, material and the like are not limited. The structure of conversion member is not limited. The screw direction of the worm of the worm gear is not limited. The structure of the printer section is not limited to the tandem type, and a revolver type developing device may be used in which an image on a single image carrier is sequentially transferred to a belt material, a sheet transferred by the belt member or the like.

What is claimed is:

1. A belt transfer device, comprising:

a belt member that supports an image and travels along a traveling direction;

a first detection roller that rotates upon contact with a first end of the belt member in a width direction;

a second detection roller that rotates upon contact with a second end of the belt member opposite to the first end;

a tension member that moves the first detection roller and the second detection roller to an area of contact with the belt member;

a conversion member that converts rotation of the first detection roller or the second detection roller into linear driving;

a transmission member driven by the linear driving of the conversion member; and a steering member that changes the traveling direction of the belt member by an operation of the transmission member.

2. The device of claim 1, wherein the conversion member includes a worm, a shaft that coaxially supports the worm and is linearly moved by rotation of the first detection roller or the second detection roller, and a fixed worm wheel that engages with the worm.

3. The device of claim 1, wherein the belt member includes ribs on an inner periphery at the ends in the width direction, the first detection roller is rotated by contact with the rib at the first end of the belt member, the second detection roller is rotated by contact with the rib at the second end of the belt member, the steering member changes the traveling direction of the belt member by the rotation of the first detection roller to move the belt member to a side of the first end, and the steering member changes the traveling direction of the belt member by the rotation of the second detection roller to move the belt member to a side of the second end.

4. The device of claim 1, wherein the first detection roller is rotated by the contact with an inner periphery of the belt member at the first end, the second detection roller is rotated by the contact with an inner periphery of the belt member at the second end, the steering member changes the traveling direction of the belt member by the rotation of the first detection roller to move the belt member to a side of the second end, and the steering member changes the traveling direction of the belt member by the rotation of the second detection roller to move the belt member to a side of the first end.

5. The device of claim 1, further comprising a first urging member to urge the first detection roller toward the first end of the belt member and a second urging member to urge the first detection roller toward the first end of the belt member.

6. A belt transfer device, comprising:

a belt member that supports an image and travels along a traveling direction;

a first detection roller that rotates upon contact with a first end of the belt member in a width direction;

a second detection roller that rotates upon contact with a second end of the belt member opposite to the first end;

a conversion member that converts rotation of the first detection roller or the second detection roller into linear driving;

a transmission member driven by the linear driving of the conversion member;

a steering member that changes the traveling direction of the belt member by an operation of the transmission member; and an indicating member that indicates a movement amount of the steering member.

7. The device of claim 6, wherein an abnormality is detected by the movement amount of the steering member indicated on the indicating member.

8. A belt transfer device, comprising:

a belt member that supports an image and travels along a traveling direction;

a first detection roller that rotates upon contact with a first end of the belt member in a width direction;

a second detection roller that rotates upon contact with a second end of the belt member opposite to the first end;

a conversion member that converts rotation of the first detection roller or the second detection roller into linear driving;

a transmission member driven by the linear driving of the conversion member;

a steering member that changes the traveling direction of the belt member by an operation of the transmission member; and an elastic member provided between a support member of the steering member and a fixed member that supports the support member.

9. A belt transfer device, comprising:

a belt member that supports an image and travels along a traveling direction;

a first detection roller that rotates upon contact with a first end of the belt member in a width direction;

a second detection roller that rotates upon contact with a second end of the belt member opposite to the first end;

a conversion member to convert rotation of the first detection roller or the second detection roller into linear driving;

a transmission member driven by the linear driving of the conversion member;

a steering member that changes the traveling direction of the belt member by an operation of the transmission member; and a tension member that moves the first detection roller and the second detection roller to an area of contact with the belt member.

10. The device of claim 9, further comprising a support member that rotates and supports the steering member and causes the steering member to give a tensile force to the belt member, wherein the tension member includes a first lever one end of which is fixed to a lever fulcrum provided on the support member and the other end of which supports a first roller shaft that supports the first detection roller or a second roller shaft that supports the second detection roller, and a second lever one end of which is fixed to the lever fulcrum and the other end of which is stopped, and lengths of the first lever and the second lever are set to cause the first detection roller and the second detection roller to move to an area of contact with the belt member by rotating the support member.

11. The device of claim 10, wherein when a movement amount of the first detection roller or the second detection roller by the rotation of the support member is made L times larger than a movement amount of the lever fulcrum, a length of the first lever is set to be L times larger than a length of the second lever.

12. The device of claim 9, wherein the belt member includes ribs on an inner periphery at the ends in the width direction, the first detection roller is rotated by contact with the rib at the first end of the belt member, the second detection roller is rotated by contact with the rib at the second end of the belt member, the steering member changes the traveling direction of the belt member by the rotation of the first detection roller to move the belt member to a side of the first end, and the steering member changes the traveling direction of the belt member by the rotation of the second detection roller to move the belt member to a side of the second end.

13. The device of claim 9, wherein the first detection roller is rotated by contact with an inner periphery of the belt member at the first end, the second detection roller is rotated by contact with the inner periphery of the belt member at the second end, the steering member changes the traveling direction of the belt member by the rotation of the first detection roller to move the belt member to a side of the second end, and the steering member changes the traveling direction of the belt member by the rotation of the second detection roller to move the belt member to a side of the first end.

14. A self steering method of a belt, comprising:

rotating a first detection roller by contact with a first end, in a width direction, of a rotated and traveling belt member, and rotating a second detection roller by contact with a second end, in the width direction, of the belt member;

moving the first detection roller and the second detection roller to an area of contact with the belt member by using a tension member;

converting rotation of the first detection roller or rotation of the second detection roller into linear driving; and tilting a steering member by an operation of the linear driving.

15. The method of claim 14, wherein rotation of the first detection roller or rotation of the second detection roller is converted into linear driving.

16. The method of claim 14, wherein when the belt member moves to rotate the first detection roller or the second detection roller, the first detection roller or the second detection roller is moved in a same direction as the movement direction of the belt member.

17. The method of claim 14, wherein the belt member includes ribs on an inner periphery at the ends in the width direction, the steering member changes a traveling direction of the belt member by the rotation of the first detection roller to move the belt member to a side of the first end, and the steering member changes the traveling direction of the belt member by the rotation of the second detection roller to move the belt member to a side of the second end.

18. The method of claim 14, wherein when the first detection roller is rotated by the contact with an inner periphery of the belt member at the first end, the steering member changes a traveling direction of the belt member to move the belt member to a side of the second end, and when the second detection roller is rotated by the contact with an inner periphery of the belt member at the second end, the steering member changes the traveling direction of the belt member to move the belt member to a side of the first end.

19. The method of claim 14, wherein the first detection roller is urged in a direction toward the first end of the belt member and the second detection roller is urged in a direction toward the second end of the belt member.

20. The method of claim 14, wherein when the first detection roller or the second detection roller is rotated, the belt member is pressed to a direction of inner periphery of the belt member.

21. A self steering method of a belt, comprising:

rotating a first detection roller by contact with a first end, in a width direction, of a rotated and traveling belt member, and rotating a second detection roller by contact with a second end, in the width direction, of the belt member;

converting rotation of the first detection roller or rotation of the second detection roller into linear driving;

tilting a steering member by an operation of the linear driving; and indicating a movement amount of the steering member.

22. A self steering method of a belt, comprising:

rotating a first detection roller by contact with a first end, in a width direction, of a rotated and traveling belt member, and rotating a second detection roller by contact with a second end, in the width direction, of the belt member;

converting rotation of the first detection roller or rotation of the second detection roller into linear driving;

tilting a steering member by an operation of the linear driving;

rotating a support member of the steering member to give tension to the belt member by the steering member; and rotating a first lever in accordance with rotation of the support member to move the first detection roller and the second detection roller to an area of contact with the belt member.

23. The method of claim 22, wherein when the belt member moves to rotate the first detection roller or the second detection roller, the first detection roller or the second detection roller is moved in a same direction as the movement direction of the belt member.

24. The method of claim 22, wherein the belt member includes ribs on an inner periphery at the ends in the width direction, the steering member changes a traveling direction of the belt member by the rotation of the first detection roller to move the belt member to a side of the first end, and the steering member changes the traveling direction of the belt member by the rotation of the second detection roller to move the belt member to a side of the second end.

25. The method of claim 22, wherein when the first detection roller is rotated by the contact with an inner periphery of the belt member at the first end, the steering member changes a traveling direction of the belt member to move the belt member to a side of the second end, and when the second detection roller is rotated by the contact with an inner periphery of the belt member at the second end, the steering member changes the traveling direction of the belt member to move the belt member to a side of the first end.

* * * * *